US008202130B2

(12) United States Patent
Friese et al.

(10) Patent No.: US 8,202,130 B2
(45) Date of Patent: Jun. 19, 2012

(54) DATA CABLE

(75) Inventors: Norbert Friese, Taufkirchen (DE); Martin Huber, Obing (DE)

(73) Assignee: MD Electronik GmbH, Waldkraiburg (DE)

( * ) Notice: Subject to any disclaimer, the term of this patent is extended or adjusted under 35 U.S.C. 154(b) by 0 days.

(21) Appl. No.: 13/057,008

(22) PCT Filed: Jul. 2, 2009

(86) PCT No.: PCT/EP2009/004781

§ 371 (c)(1),
(2), (4) Date: Feb. 1, 2011

(87) PCT Pub. No.: WO2010/012346

PCT Pub. Date: Feb. 4, 2010

(65) Prior Publication Data

US 2011/0136373 A1 Jun. 9, 2011

(30) Foreign Application Priority Data

Aug. 1, 2008 (DE) ..... 10 2008 036 399

(51) Int. Cl.
*H01R 13/648* (2006.01)

(52) U.S. Cl. ..... 439/736; 439/607.51; 29/858; 29/861

(58) Field of Classification Search ..... 439/736, 439/606, 602.41, 602.51, 604; 29/858, 861
See application file for complete search history.

(56) References Cited

U.S. PATENT DOCUMENTS

| | | | | |
|---|---|---|---|---|
| 4,557,545 | A * | 12/1985 | Ohtsuki et al. | 439/470 |
| 4,582,384 | A * | 4/1986 | Frantz et al. | 439/607.47 |
| 4,585,292 | A * | 4/1986 | Frantz et al. | 439/607.47 |
| 4,941,850 | A * | 7/1990 | Ankers et al. | 439/607.51 |
| 5,480,327 | A * | 1/1996 | Zola | 439/607.5 |
| 5,618,208 | A * | 4/1997 | Crouse et al. | 439/607.17 |
| 5,833,495 | A * | 11/1998 | Ito | 439/607.48 |
| 6,669,502 | B1 | 12/2003 | Bernhart et al. | |
| 6,821,151 | B2 * | 11/2004 | Lai | 439/607.51 |
| 7,090,534 | B2 * | 8/2006 | Wu et al. | 439/607.41 |
| 2009/0068891 | A1 * | 3/2009 | Osenberg | 439/610 |

FOREIGN PATENT DOCUMENTS

DE 102 05 333 A1 8/2003

* cited by examiner

*Primary Examiner* — Gary F. Paumen
(74) *Attorney, Agent, or Firm* — Brinks, Hofer, Gilson & Lione

(57) ABSTRACT

A data cable including an electrical line with a plurality of line leads, an electrical shield, a molded piece including first counterpart form-locking elements and a housing enclosing the molded piece, wherein the housing has a central opening. The data cable further including a plug connector disposed on an end of the data cable, wherein the plug connector is electrically connected to the shield, wherein the plug connector includes a bush that is enclosed by the molded piece. The bush includes a deep-drawn tube and a bead with second form-locking elements which with the counterpart form-locking elements form a first form-locking connection, wherein an outer contour of the molded piece and an inner contour of the central opening of the housing form a second form-locking connection.

27 Claims, 12 Drawing Sheets

DATA CABLE

Applicants claim, under 35 U.S.C. §§120 and 365, the benefit of priority of the filing date of Jul. 2, 2009 of a Patent Cooperation Treaty patent application, copy attached, Serial Number PCT/EP2009/004781, filed on the aforementioned date, the entire contents of which are incorporated herein by reference, wherein Patent Cooperation Treaty patent application Serial Number PCT/EP2009/004781 was not published under PCT Article 21(2) in English.

Applicants claim, under 35 U.S.C. §119, the benefit of priority of the filing date of Aug. 1, 2008 of a German patent application, copy attached, Serial Number 10 2008 036 399.5, filed on the aforementioned date, the entire contents of which is incorporated herein by reference.

BACKGROUND OF THE INVENTION

1. Field of the Invention

The present invention relates to a data cable and to a method for producing a plug connector for a data cable.

2. Description of the Related Art

A data cable of this kind in combination with a plug connector for producing a data transmission plug connection between a pin part and a socket part is used for instance in high-speed plug-in data bus systems of motor vehicles and is known from German Patent Disclosure DE 102 05 333 A1. The known plug connector includes a rotationally symmetrical bush, which for cost reasons is produced from a deep-drawn tube on the inner circumference of which an insulating part with a through-bore rests. A contact which receives the insulated core of a data line of the data cable is mounted in this through-bore. The data line is surrounded by a shield, embodied as a mesh-like outer conductor, which is connected electrically to the rotationally symmetrical bush of the plug connector. The deep-drawn tube has a bead, formed from a crease of the tube, which serves as a stop for a fitting piece that is embodied as a plastic injection molded part and is slipped onto the tube with a press fit and that has grooves made on its outer contour. A housing surrounds the tube and the fitting piece and, for axially fixing the housing, engages the grooves with a detent and locking structure.

A data cable embodied on the so-called "star quad" principle includes 1) four line leads located inside the cable jacket and insulated from one another and 2) a shield surrounding the line leads, wherein the shield is in the form of a mesh shield that is electrically connected to the bush of the plug connector. If the cable is based on the "star quad" principle, then it is necessary that the electrical contacts of the plug connector that are connected to the line leads and that protrude from the face end of the insulating part are unambiguously aligned with the housing of the plug connector. To that end, during the assembly of the plug connector, the housing of the plug connector must assume an unambiguous angular position relative to the line leads of the data cable, or to contact pins or contact sockets located in the insulating part and connected to the line leads. In addition, the housing must be fixed not only axially on the deep-drawn tube but also fixed on the deep-drawn tube in the circumferential direction as well, in a manner fixed against relative rotation.

SUMMARY AND OBJECTS OF THE INVENTION

It is therefore an object of the present invention to embody a data cable of the type defined at the outset, with a plug connector disposed on the end of the data cable and having a preferably rotationally symmetrical bush, such that axial fixation of the housing of the plug connector is assured in a simple way. In addition, it is an object of the present invention to embody a data cable so that an association, in a manner fixed against relative rotation, with an unambiguous angular position of the housing of the plug connector relative to the line leads of the data cable is assured in a simple way.

This object is attained according to the present invention by a data cable including an electrical line with a plurality of line leads, an electrical shield, a molded piece including first counterpart form-locking elements and a housing enclosing the molded piece, wherein the housing has a central opening. The data cable further including a plug connector disposed on an end of the data cable, wherein the plug connector is electrically connected to the shield, wherein the plug connector includes a bush that is enclosed by the molded piece. The bush includes a deep-drawn tube and a bead with second form-locking elements which with the counterpart form-locking elements form a first form-locking connection, wherein an outer contour of the molded piece and an inner contour of the central opening of the housing form a second form-locking connection.

The embodiment according to the present invention ensures both an axial fixation of the housing of the plug connector and an association of the housing of the plug connector with line leads of the data cable in a manner fixed against relative rotation and with an unambiguous relative angular position, by a simple mechanical structure and with easy assembly.

By the form-locking connections between the bead of the deep-drawn tube and the molded piece on the one hand and between the molded piece and the housing on the other, an unambiguous association of the housing of the plug connector with the line leads of the data cable and optionally with orientation aids disposed on the housing is created in a manner fixed against relative rotation.

Preferably, the form-locking elements of the bead include stamped out or cut out perforations, recesses, or a non-rotationally-symmetrical periphery of the bead.

The form-locking relative rotation prevention, based on the meshing of the form-locking elements of the bead and the counterpart form-locking elements of the molded piece, is generated only after the deep drawing of the essentially rotationally symmetrical tube that forms the bush of the plug connector, by stamping or cutting the form-locking elements out of the bead or in some similar way. Such form-locking relative rotation prevention prevents perforations, recesses or other removals of material that might have been made before the deep drawing from weakening the material and making the deep drawing of the tube more difficult or even impossible.

To furnish the largest possible surface area of recesses, perforations or other removals of material for forming the form-locking elements on the bead, and to produce the bead in a simple way and without weakening the material, the bead extends annularly around the bush and is preferably formed by a defined compressing of the deep-drawn tube.

The essentially rotationally symmetrical bush has an inward-oriented tongue, formed in the deep drawing of the tub, that corresponds with a groove of an insulating part which is inserted into the bush and receives the line leads, or contact pins or contact sockets connected to the line leads. This structure ensures that the insulating part can be connected to the bush only in an unambiguous relative angular position, which is the prerequisite so that the further parts of the plug connector that are to be connected to the bush are aligned in an unambiguous relative angular position with regard to the line leads of the data cable.

By an encircling crimp mounted on the deep-drawn tube, an increase in the retention forces of the further parts of the plug connector that are to be connected to the bush is attained.

The molded piece can either be attached to the bush in mold injection by a high-pressure injection molding process, or it can be embodied as an injection molded part that is slipped or press-fitted onto the bush. The molded piece embodied as an injection molded part has a central opening into which the bush is inserted in such a way that the recesses, perforations, or the peripheral contour of the bead are press-fitted into complementary protrusions or contours.

In the extrusion-coating of the sleeve, given a suitable length of the molded piece, an additional tension relief of the data cable is simultaneously provided, and protruding individual stranded wires of the shield are additionally covered.

When a molded piece embodied as an injection molded part is used, to ensure an unambiguous relative angular position between the line leads of the data cable and the molded piece, a mechanical code is preferably employed. The mechanical code aids the molded piece embodied as an injection molded part to be slipped onto the bead only in a specified alignment. This mechanical code can be produced by a predeterminable structuring of the recesses, perforations or peripheral contour of the bead, and by a counterpart structure adapted to the predetermined structure of the central opening of the molded piece. For example, the recesses, perforation or peripheral contour of the bead can be provided with an additional notch or peripheral flattening, and the central opening of the molded piece can be provided with a tongue adapted to the notch, or with a rib adapted to the peripheral flattening, which allows the molded piece embodied as an injection molded part to be connected to the deep-drawn tube only in the predetermined direction and thus in an unambiguous relative angular position.

The outer body of the plug connector is formed by an outer housing, which has a central opening the inner surface of which has a recess, perforation, or asymmetrical contour that is adapted to an asymmetrical contour of the outer surface of the molded piece so that the directionally oriented relative rotation prevention extends from the line leads to the housing.

In a preferred feature, the molded piece is embodied in the shape of a cube or oblong block, and one corner of the square or rectangular outer surface of the molded piece is chamfered, while the inner surface of the central opening of the housing has a chamfer corresponding to it.

Preferably, the housing is fixed on the molded piece in a relative angular position that is predetermined by the recess, perforation or asymmetrical contour, and the molded piece is slipped on and fixed by a radially adjustable securing element.

In this way, the outer housing is fixed with regard to the line leads in a manner fixed against relative rotation, and thus an axial and circumferentially fixed association between the outer housing and the line leads of the data cable is ensured via the molded piece, the bead of the bush, the inward-oriented tongue of the bush, and the insulating part provided with a groove. This fixation of the outer housing is important, particularly in multi-lead systems, in contrast to a single-lead data cable with a data line, in order to ensure an unambiguous relative angular position between the line leads of the data cable and the outer housing.

In a further feature, a coding device is disposed on the free end of the plug connector, which free end is opposite from the cable lead-in into the plug connector. The coding device ensures a correct alignment of the plug connector with a counterpart plug connector for the sake of correct line connection. In particular, the coding device includes ribs that protrude from the periphery of the face end of the insulating part and rest on the inner circumference of the bush so that a counterpart plug connector can be coupled to the plug connector only in an unambiguous relative angular position.

As an additional aid in orientation for aligning the plug connector with a counterpart plug connector or a complementary plug or outlet part, a bar code, color or shape code or the like can be disposed on the outer surface of the housing.

Exemplary embodiments of the present invention are shown in the drawings and are described in further detail below in conjunction with the drawings. Shown are:

DESCRIPTION OF THE PREFERRED EMBODIMENT(S) OF THE INVENTION

Figure 1:
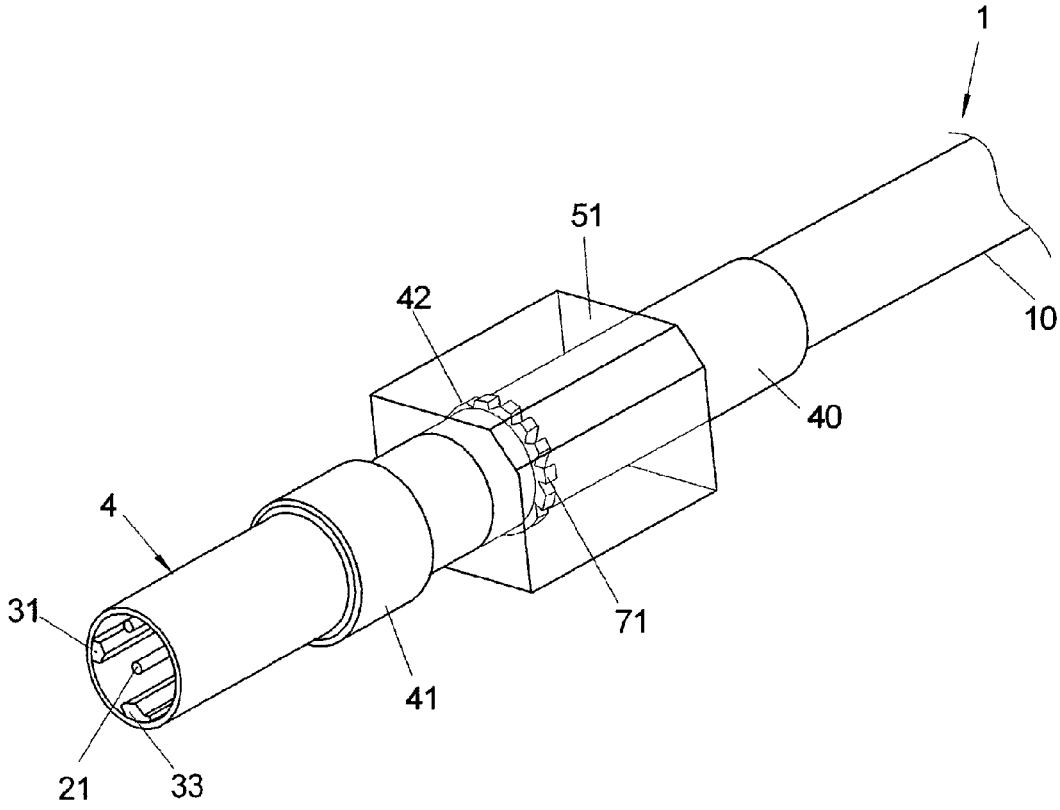
FIG. 1 is a perspective view of an end region of a first embodiment of a data cable with a bush of a plug connector and a bead with form-locking elements embodied on the bead in accordance with the present invention.

The principle of the present invention of a form-locking relative rotation preventer for a 1) molded piece 51, with an essentially rotationally symmetrical bush 4 produced from a deep-drawn tube 40 and with a housing 6, for form-locking axial fixation and in the circumferential direction in an unambiguous relative angular position to the line leads of a data cable 1 and 2) a plug connector 2 disposed on the end of the data cable 1, will now be described in conjunction with FIGS. 1-6. As a result of the form-locking relative rotation preventers between the bush 4, the molded piece 51 and the housing 6, the housing 6 of the plug connector 2 is aligned and fixed in an unambiguous relative angular position with regard to contact pins 21 (or contact sockets 22 in FIGS. 17-22) inserted into bores of an insulating part 3. Note that the insulating part 3 is aligned by a tongue-and-groove guide in the circumferential direction and is disposed in fixed fashion in the bush 4, and is thus aligned and fixed with regard to the line leads of the data cable 1. Thus, unlike what in this respect is an unproblematic coaxial cable, even with a non-rotationally-symmetrical conductor arrangement of the data cable 1, an unambiguous association of the housing 6 with the line leads of the data cable is ensured, so that misconnections on connecting the plug connector 2 to a counterpart plug connector can be precluded.

FIG. 1 shows an end piece of a data cable 1, whose cable jacket 10 surrounds both a shield and a plurality of line leads disposed non-rotationally-symmetrically. The line leads are disposed in insulated fashion in a bush 4 and are connected to contact pins 21. The shield is connected to the bush 4, which includes an electrically conductive material. The bush 4 includes a deep-drawn tube 40, which has a 1) cylindrical attachment 41 and 2) an annularly closed bead 42 that is embodied on the tube 40 by defined compressing. The annularly closed bead 42 is provided with form-locking elements 71 embodied as recesses, which are stamped or cut into the bead 42 after the deep drawing process for producing the deep-drawn tube 40 and after the defined compressing of the bead 42. The form-locking elements 71 furnish part of a form-locking connection for form-locking relative rotation prevention for a molded piece 51 whose outlines are shown schematically in FIG. 1.

Figure 2:
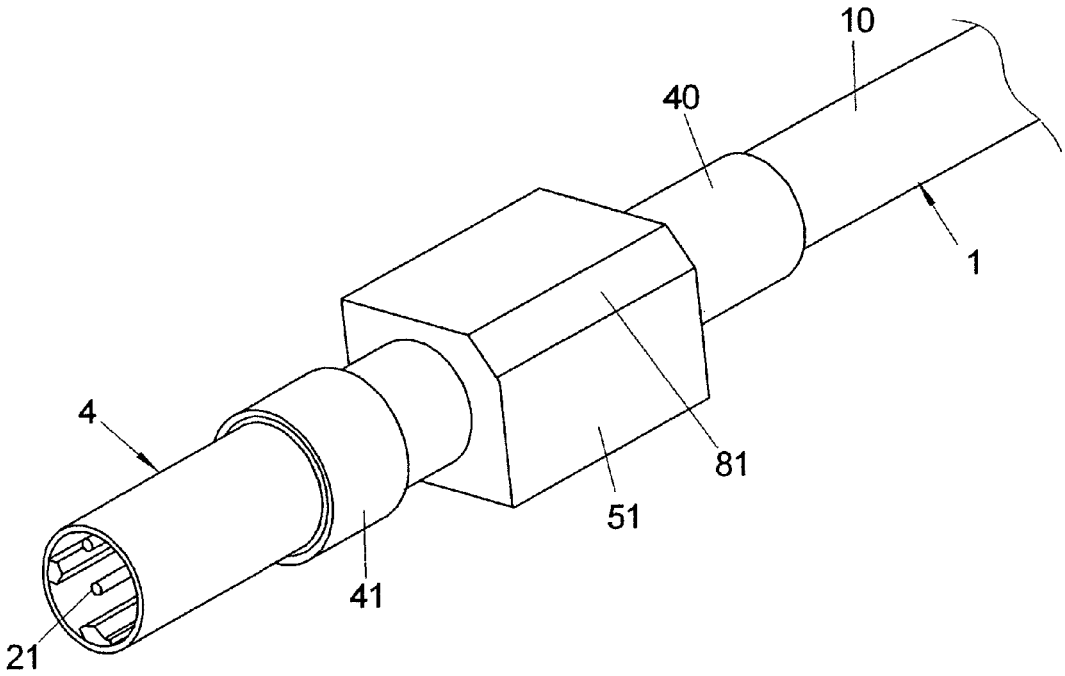
FIG. 2 is a perspective view of the embodiment of FIG. 1 with an embodiment of a molded piece a molded piece connected to the bush in form-locking fashion and fixed against relative rotation.
Figure 3:
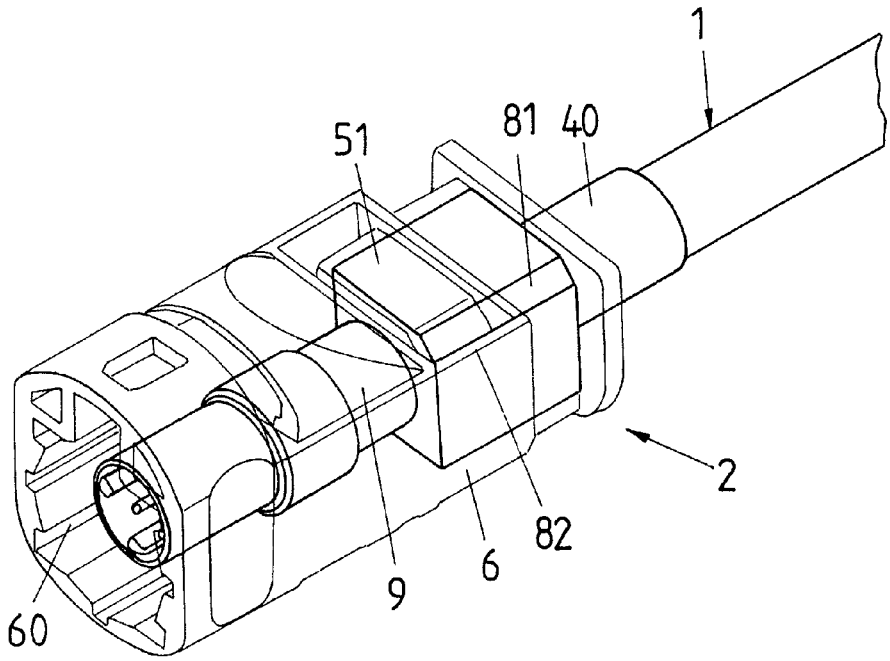
FIG. 3 is a perspective view of the embodiment of FIG. 2 with an embodiment of a housing of the plug connector connected to the bush and the molded piece in a manner fixed against relative rotation in accordance with the present invention.

FIG. 2 shows the bush 4 with the molded piece 51, connected to the bush 4 in form-locking fashion and in a manner fixed against relative rotation. In a first embodiment, the molded piece 51 is mounted as an extrusion coating directly on the bush 4 as follows: the bush 4 is placed in the mold of an injection molding machine such that it is aligned with the tongue (see FIG. 10) embodied in the deep-drawn tube 40, and a plastic, in particular an elastomer, is then injected into the mold so that the molded piece 51 is formed.

In a second embodiment, the molded piece 51 can be produced as a separate injection molded part, which has a central opening that is slipped onto the bush 4 such that the bead 42 and its form-locking elements 71 are press-fitted into the complementary central opening in the molded piece 51. In this process, the tongue embodied in the deep-drawn tube 40 likewise serves to define the mutual alignment of the deep-drawn tube 40 and the molded piece 51. Alternatively or in addition, an unambiguous association between the bush 4 and the molded piece 51 can be attained by a mechanical code, such as an irregular contour of the form-locking elements 71 of the bead 42 and a corresponding contrary contour of the counterpart form-locking elements of the molded piece 51. The mechanical code results in the line leads, introduced into the bush 4 in a defined alignment, being aligned radially with the molded piece 51 in a predetermined manner.

On its outer surface, the molded piece 51 is in the form of an oblong block of square cross section with a chamfered corner as shown in FIGS. 1-2. The chamfered corner of the molded piece 51 defines a further form-locking element 81. This further form-locking element 81 serves to establish a second form-locking connection with an outer housing 6, which is shown in outlines in FIG. 3. A central recess 60 of the outer housing 6 is slipped axially onto the bush 4 and the molded piece 51 along a longitudinal axis of the bush 4. The outer housing 6 is secured axially to the bush 4 by a radially adjustable securing element 9. In its central opening 60, the housing 6 has a counterpart form-locking element 82 that has a contour adapted to the contour of the form-locking element 81 disposed on the outside of the molded piece 51. The form locking element 81 and the counter form locking element 82 define a further form-locking relative rotation preventer between the molded piece 51 and the housing 6 and thus an unambiguous angular association with the line leads of the data cable 1 or the contact pins 21 or contact sockets 22 of the plug connector 2 is produced.

Figure 4:
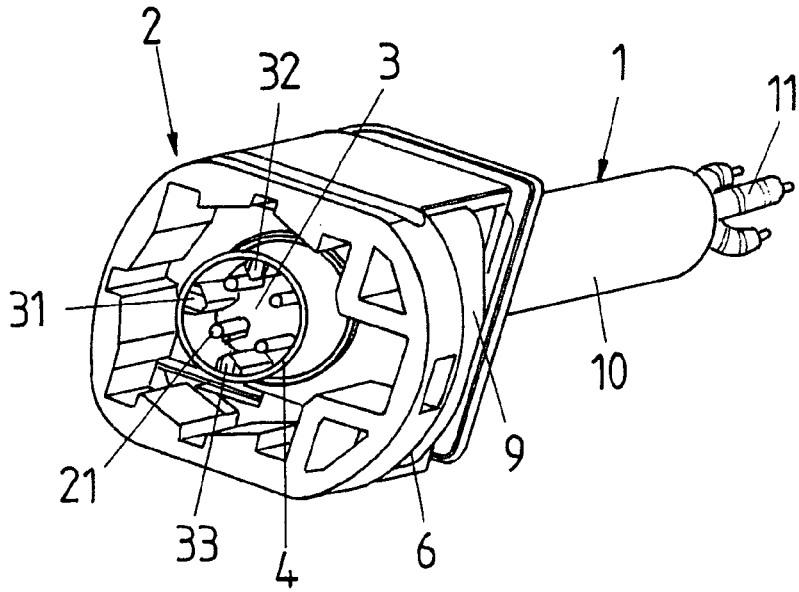
FIG. 4 is a perspective top view on a face end of the plug connector of FIG. 3 with an embodiment of an insulating part that is inserted into the bush and has contact pins and ribs for mechanical coding in accordance with the present invention.

FIG. 4 shows the housing 6, provided with a contoured interior, and the face end of the bush 4 with an insulating part 3 disposed in the bush. As shown in FIG. 4, four contact pins 21 protrude from the face end of the insulating part 3 and are inserted into bores in the insulating part 3 and are connected to the line leads of the data cable 1. To ensure that the plug connector 2 can be introduced into the counterpart of a further plug connector in only one position, three ribs 31, 32, 33, contacting the inner circumference of the bush 4 and forming the corner points of an equilateral triangle, protrude from the periphery of the face end of the insulating part 3 and act as a coding device.

The perspective front and rear views of the plug connector 2 illustrate the disposition and function of the radially adjustable securing element 9. In particular, radial displacement of the securing elements relation to the longitudinal axis of the bush 4 results in the housing 6 being fixed axially on the bush 4 and the molded piece 51.

Figure 7:
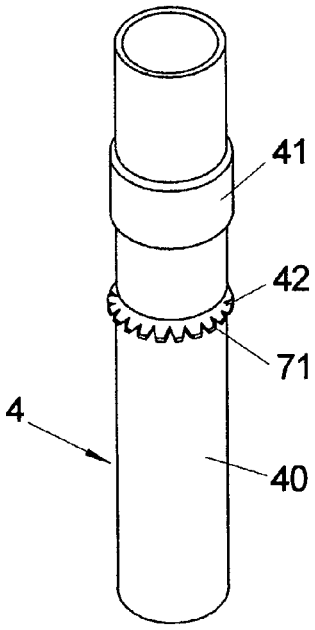
FIG. 7 is a perspective view of the bush of FIGS. 1-6 that includes a deep-drawn tube and stamped out recesses, the deep-drawn tube having a compressed bead.
Figure 8:
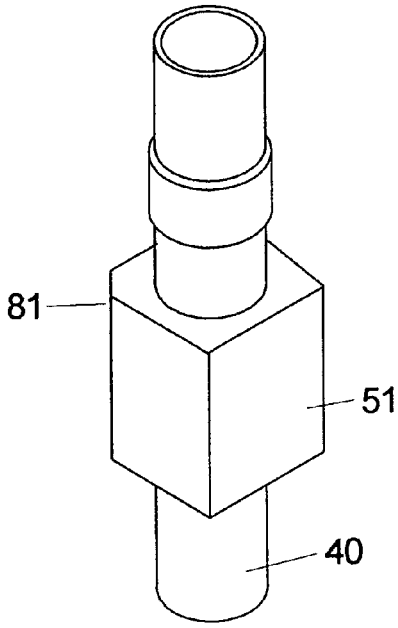
FIG. 8 is a perspective view of the bush of FIG. 7 with the molded piece of FIGS. 1-6 surrounding the bead and having a corner chamfer.

FIG. 7 shows the deep-drawn tube 40 of the bush 4 with the annular bead 42 embodied by defined compressing of the deep-drawn tube 40. FIG. 7 also shows the form-locking elements 71 embodied in the form of recesses in the bead by stamping or cutting before the connection to the molded piece 51. The molded piece 51 is then formed integrally onto the deep-drawn tube 40 by being extrusion-coated onto the deep-drawn tube 40 by a high-pressure injection molding process. Alternatively, the bush 4 is introduced into the central opening of a molded piece 51, embodied as an injection molded part, in such a way that the form-locking elements 71 of the bead 42 are press-fitted into the complementary counterpart form-locking elements of the central opening of the molded piece 51. In both variant embodiments, form-locking relative rotation prevention is established between the bush 4 and the molded piece 51.

Figure 9:
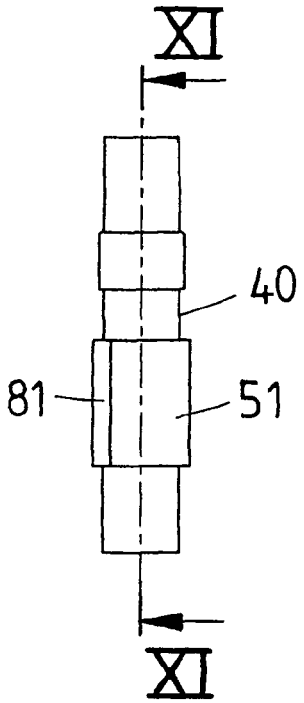
FIG. 9 is a side view of the bush with the molded piece of FIG. 8.
Figure 10:
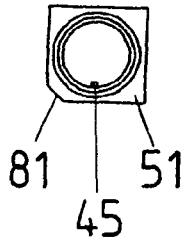
FIG. 10 is a top view of the bush with the molded piece of FIG. 8.
Figure 11:
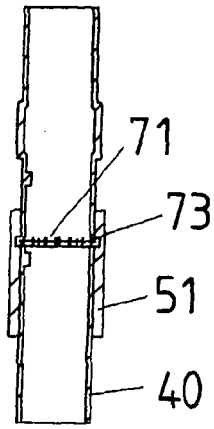
FIG. 11 is a section through the bush and the molded piece of FIGS. 8-10 taken along the line VIII-VIII in FIG. 8.

The bush 4 with the molded piece 51 connected to it in form-locking fashion and fixed against relative rotation is shown in FIGS. 9-11 in a side view, a top view, and a section along the line XI-XI of FIG. 9, respectively.

The sectional view in FIG. 11 illustrates the axial form lock between the bead 42 and the central opening of the molded piece 51. FIG. 11 also shows the radial form lock between the form-locking elements 71 embodied on the bead 42 and the counterpart form-locking elements 73 embodied in the central opening of the molded piece 51.

Figure 5:
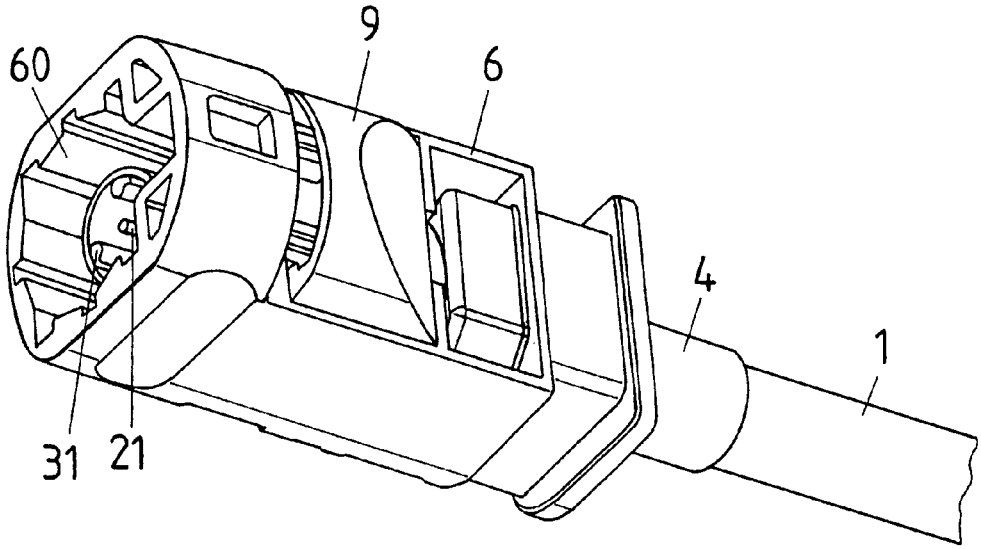
FIGS. 5 and 6 show perspective front and rear views of the plug connector of FIGS. 3-4 connected to the data cable of FIG. 2.
Figure 6:
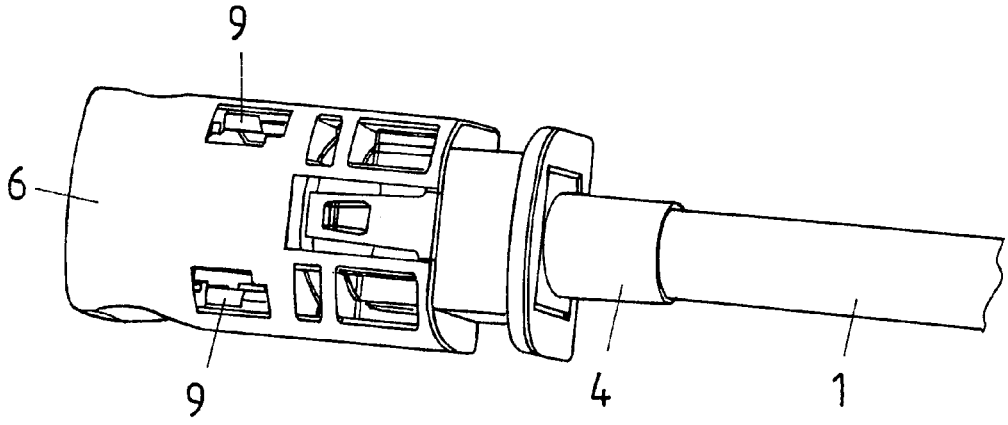

The top view on the bush 4 of FIG. 10 shows the tongue 45, embodied on the cylindrical inner surface of the deep-drawn tube 40. A complementary groove of the insulating part 3 of FIGS. 4-6 is slipped onto the tongue 45.

In FIGS. 12-22, two variant embodiments are shown, for a pin and socket form of the plug connector, respectively. Elements of the data cable 1 and plug connector 2 matching those of the drawings described above are identified by the same reference numerals, so to avoid repetition, the reader is referred to the above description.

Figure 12:
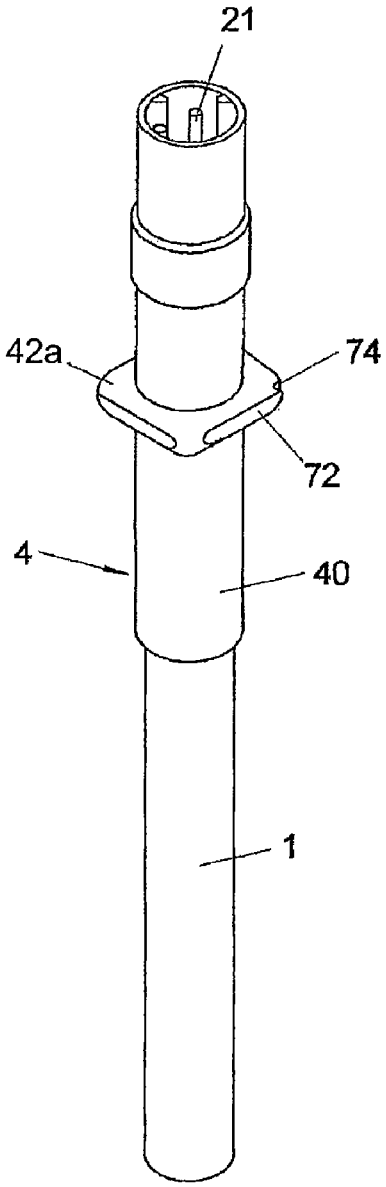
FIG. 12 is a perspective view of an end region of a second embodiment of a data cable having an essentially rotationally symmetrical bush, a compressed bead with a non-rotationally-symmetrical outer contour, and contact pins in accordance with the present invention.

FIG. 12 shows a plug connector, embodied as a contact pin connection, with contact pins 21 and a bead 42*a* whose form-locking elements are embodied as a square outer contour 72 of the bead 42*a*. The contour 72 is produced by suitable cutting or stamping and is provided with a notch 74 functions as an orientation element for angular association of the bead 42*a* with the insulating part 3 inserted into the opening in the deep-drawn tube 40 on the one hand and with a molded piece (not shown) on the other. The molded piece is similar to the molded piece 52 of FIGS. 1-11 but is shorter in the axial direction. The molded piece is either integrally injection molded onto the deep-drawn tube 40 in the vicinity of the bead 42*a* or slipped as an injection molded part onto the deep-drawn tube 40 in a manner previously described with respect to molded piece 52 of FIGS. 1-11.

Figure 13:
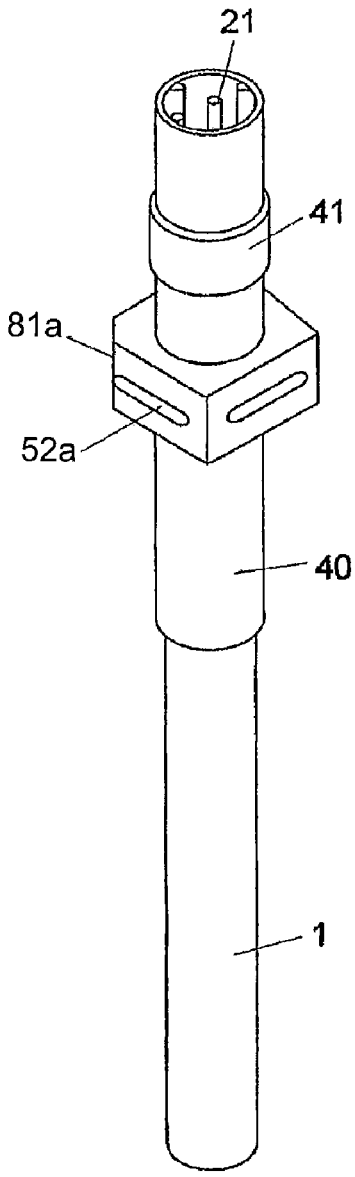
FIG. 13 is a perspective view of an end region of a third embodiment of a data cable having a bush as in FIG. 12 and a short molded piece, surrounding the bead, with a corner chamfer in accordance with the present invention.
Figure 14:
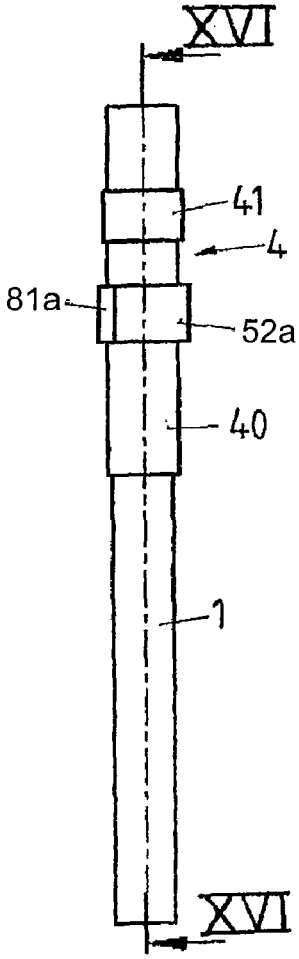
FIG. 14 is a side view of the bush with the molded piece of FIG. 13.
Figure 16:
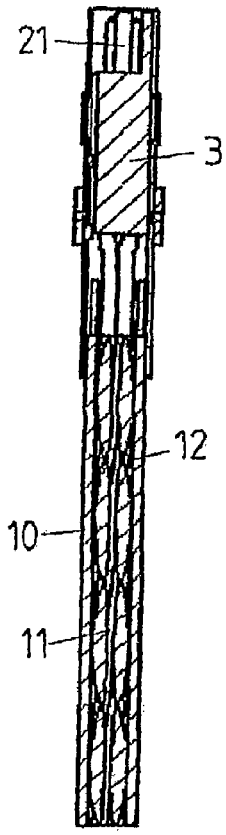
FIG. 16 is a section through the bush and the molded piece of FIGS. 13-15 taken along the line XVI-XVI in FIG. 14.

FIG. 13 shows a side view on an end piece of the data cable 1 with the bush 4 and the molded piece 52*a*, whose chamfered outer edge is embodied as a form-locking element 81*a* for making a second form-locking connection with the housing 6 in FIGS. 3-6. As shown in FIG. 16, the data cable 1 has a cable jacket 10 having both the twisted line leads 11, which are provided with a cable insulation, and an electrical shield 12, which is connected to the bush 4. The insulated line leads 11 provided with contact pins 21 are passed through precise longitudinal bores in the insulating part 3, which is inserted into the deep-drawn tube 40 of the bush 4 in a predetermined orientation.

Figure 15:
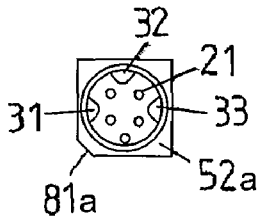
FIG. 15 is a top view of the bush with the molded piece of FIG. 14.
Figure 17:
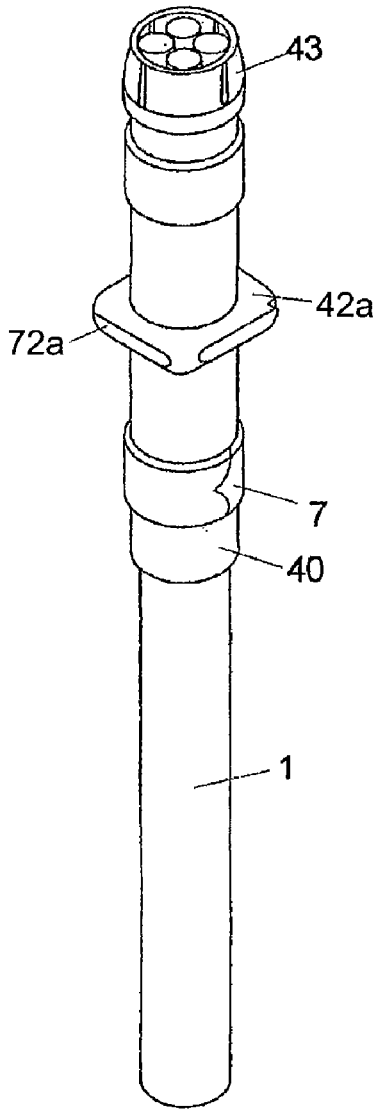
FIG. 17 is a perspective view of an end region of a fourth embodiment of a data cable having an essentially rotationally symmetrical bush, a compressed bead with a non-rotationally-symmetrical outer contour, and contact sockets as well as a encircling crimp in accordance with the present invention.

FIG. 15 shows the contact pins arranged on the star-quad principle. FIG. 15 also shows inward-oriented ribs 31-33 of the insulating part 3 for mechanical coding for an unambiguous angular position between the line leads 11, or contact pins 21, and the bush 4. Since the molded piece 52 is connected to the bush 4 in form-locking fashion and fixed against relative rotation and thus with the housing 6, likewise connected to the molded piece 52 in form-locking fashion and fixed against relative rotation, as shown in FIGS. 3-6, the angular position between the leads 11 or contact pins 21 and the molded piece 52.

FIGS. 17-22 show a plug connector, embodied as a contact socket connector, with contact sockets 22, a cylindrical-annular attachment 41, a bead 42*a* formed by compressing of the deep-drawn tube 40 and having a square outer contour as a form-locking element 72*a* corresponding to the form-locking element 72*a* of FIG. 12, and a socket 43 surrounding the contact pins 22. On its chamfered or rounded corners, the square outer contour 72*a* of the bead 42*a*, produced by suitable cutting or stamping, has a notch 74. The notch 74 allows for angular association of the bead 42*a* with both the insulating part 3, inserted into the opening of the deep-drawn tube 40, and the molded piece 53, which is injection molded onto or slipped as an injection molded part onto the deep-drawn tube 40 in the vicinity of the bead 42*a*.

Figure 18:
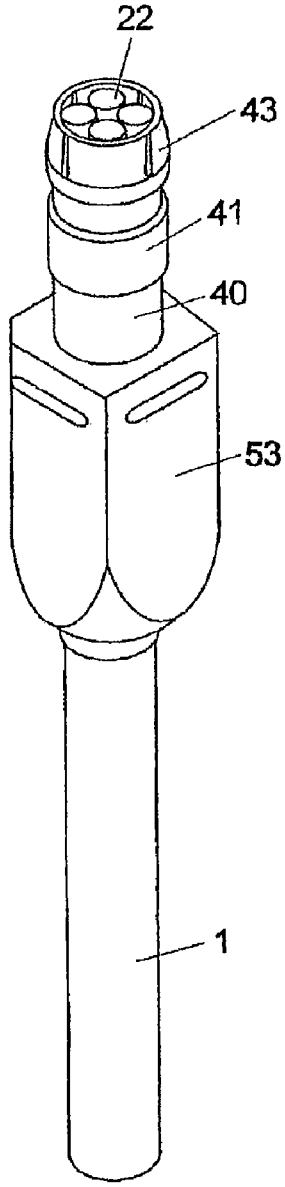
FIG. 18 is a perspective view of the end region of a data cable having a bush as in FIG. 17 and an embodiment of a long form-locking element, surrounding the bead, with a corner chamfer and tension relief in accordance with the present invention.

To increase the force absorption in the axial direction directed along the longitudinal axis of the bush 40, an encircling crimp 7 is placed around the deep-drawn tube 40 and is connected in form-locking fashion to the injection-molded or slipped-on molded piece 53 in FIG. 18.

Figure 19:
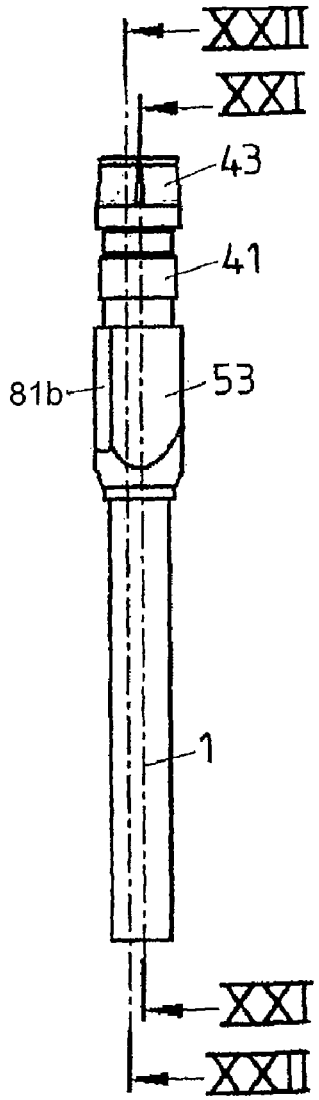
FIG. 19 is a side view of the bush with the molded piece of FIG. 18.

FIG. 19 shows a side view of the end piece of the data cable 1 with the bush 4 and the bead 42 onto which the molded piece 53 is injection molded for slipped on as an injection molded part. The molded piece 53, which in this embodiment is long, is chamfered on its end toward the data cable 1. In addition, the molded piece 53 has a chamfered outer edge for forming a form-locking element 81*b*, which with a correspondingly chambered inner surface 82 corresponds to the central opening 60 of the housing 6 in FIGS. 3-6.

Figure 21:
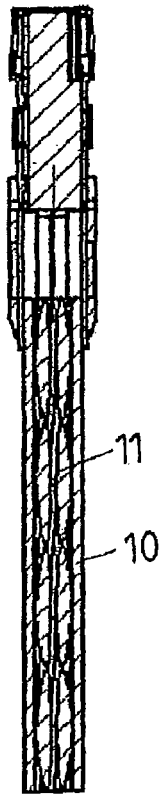
FIG. 21 is a section through the bush and the molded piece of FIGS. 18-20 taken along the line XXI-XXI in FIG. 19.
Figure 22:
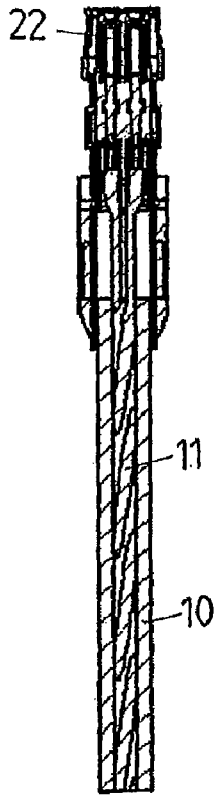
FIG. 22 is a section through the bush and the molded piece of FIGS. 18-20 taken along the line XXII-XXII in FIG. 19.

As shown in FIGS. 21 and 22 the cable jacket 10 with the line leads 11, disposed in twisted fashion in it and provided with a cable insulation, includes an electrical shield 12 (see FIG. 16), which is connected to the bush 4. The insulated line leads of the data cable 1 that are connected to contact sockets 22 are inserted through the longitudinal bores of the insulating part 3, which is inserted into the deep-drawn tube 40 of the bush 4 in a predetermined orientation, by a tongue-and-groove association between the cylindrical inner surface of the bush 4 and of the insulating part 3.

Figure 20:
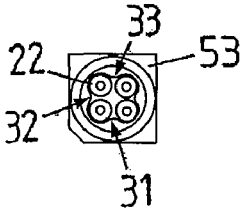
FIG. 20 is a top view of the bush with the molded piece of FIG. 19.

FIG. 20 shows the contact sockets 22 arranged on the star-quad principle and the inward-oriented ribs 31-33 of the insulating part 3 for mechanical coding. The ribs 31-33 function as a coding for unambiguous angular association between the line leads 11 of the data cable 1 or the contact sockets 22 and the bush 4. Since the molded piece 53 is connected to the bush 4 in form-locking fashion and fixed against relative rotation the line leads 11 are arranged in unambiguous angular association also with the molded piece 53. Consequently, the line leads 11 are arranged in unambiguous association with the housing 6, as the molded piece 53 is arranged in form-locking fashion and fixed against relative rotation via the form-locking element 81 of the molded piece 53 and via the corresponding counterpart form-locking element 82 of the housing 6 of FIGS. 3-6.

Further embodiment variations of the method and devices in accordance with the present invention of course exist besides the explained examples and embodiments.

The invention claimed is:

1. A data cable comprising:

an electrical line with a plurality of line leads;

an electrical shield;

a molded piece comprising first counterpart form-locking elements;

a housing enclosing said molded piece, wherein said housing has a central opening;

a plug connector disposed on an end of said data cable, wherein said plug connector is electrically connected to said shield, wherein said plug connector comprises a bush that is enclosed by said molded piece, said bush comprises:

a deep-drawn tube;

a bead with second form-locking elements which with said counterpart form-locking elements form a first form-locking connection; and wherein an outer contour of said molded piece and an inner contour of said central opening of said housing form a second form-locking connection.

2. The data cable as defined by claim 1, wherein said second form-locking elements of said bead comprise stamped out or cut out perforations, recesses, or a non-rotationally-symmetrical periphery of said bead.

3. The data cable as defined by claim 1, wherein said bead extends annularly around said bush.

4. The data cable as defined by claim 3, wherein said bead is formed by a defined compressing of said deep-drawn tube.

5. The data cable as defined by claim 1, further comprising an insulating part inserted into said bush and receiving line leads or contact pins or contact sockets that are connected to said plurality of line leads; and wherein said bush comprises an inward-oriented tongue extending in a longitudinal direction of said bush and extends into said groove of said insulating part.

6. The data cable as defined by claim 1, further comprising an encircling crimp mounted on said deep-drawn tube.

7. The data cable as defined by claim 1, wherein said molded piece is applied to said bush in mold injection by a high-pressure injection molding process.

8. The data cable as defined by claim 1, wherein said molded piece is an injection molded part and is attached or press-fitted onto said bush.

9. The data cable as defined by claim 2, wherein said molded piece is an injection molded part and is attached or press-fitted onto said bush.

10. The data cable as defined by claim 9, wherein said molded piece has a central opening into which said bush is inserted in such a way that said recesses, said perforations, or said periphery of said bead are press-fitted into complementary protrusions or contours of said molded piece.

11. The data cable as defined by claim 9, wherein said recesses, said perforations or said periphery of said bead are structured in such a way, and a central opening of said molded piece comprises a counterpart structure adapted to said recesses, said perforations or said periphery of said bead in such a way that said molded piece embodied as an injection molded part is connectable to said bush only in a predetermined radial alignment.

12. The data cable as defined by claim 1, wherein an outer surface of said molded piece has a recess, perforation, or asymmetrical contour as a form-locking element, and an inner surface of said housing has a contour, as a second counterpart form-locking element, adapted to said recess, said perforation or said asymmetrical contour of said outer surface of said molded piece; and said second counterpart form-locking element is attached onto said molded piece, or onto said bush and said molded piece, in a predetermined radial alignment and is fixed on said molded piece by a radially adjustable securing element.

13. The data cable as defined by claim 1, further comprising a coding device disposed on a free end of said plug connector that is located opposite a cable lead-in into said plug connector.

14. The data cable as defined by claim 13, wherein said coding device comprises ribs protruding from a periphery of a face end of an insulating part and contacting an inner circumference of said bush, wherein said insulating part is inserted into said bush and receives said plurality of line leads or contact pins or contact sockets that are connected to said plurality of line leads.

15. The data cable as defined by claim 1, further comprising an aid in orientation disposed on an outer surface of said housing for aligning said plug connector with a counterpart plug connector or a complementary plug part or socket part.

16. The data cable as defined by claim 15, wherein said aid in orientation is in the form of a bar code, color code or shape code.

17. A method for producing a plug connector for a data cable comprising an electrical line with a plurality of line leads and comprising an electrical shield, the method comprising:

deep-drawing an electrically conductive metal material into a deep-drawn tube forming a bush;

connecting said deep-drawn tube electrically conductively to said electrical shield;

compressing said deep-drawn tube for forming an annular bead;

stamping out or cutting out recesses and/or perforations and/or peripheral parts from said annular bead;

inserting said annular bead in an injection mold and filling said mold with a plastic for forming a molded piece;

attaching to said molded piece a prefabricated housing comprising a central opening that is adapted to an outer contour of said molded piece and that produces at least a radial form lock with said molded piece; and fixing said housing in an axial direction on said molded piece.

18. The method as defined by claim 17, further comprising:

forming an inward-oriented tongue in said deep-drawing of said tube;

aligning said deep-drawn tube relative to said tongue, on placement of at least said annular bead of said deep-drawn tube in an injection mold, in such a way that an unambiguous relative position is established between an outer contour of said molded piece and said tongue.

19. The method as defined by claim 17, further comprising mounting an encircling crimp on said deep-drawn tube.

20. The method as defined by claim 18, further comprising:

producing a cylindrical insulating part with bores for receiving said plurality of line leads, or contact pins or contact sockets connected to said plurality of line leads, and with a groove extending in a longitudinal direction of an outer surface of said cylindrical insulating part;

inserting said cylindrical insulating part into said bush in such a way that said tongue of said deep-drawn tube is inserted into said groove of said cylindrical insulating part.

21. The method as defined by claim 17, further comprising:

producing an asymmetrical contour on an outer surface of said molded piece;

producing a contour on an inner surface of said central opening of said housing that is adapted to said asymmetrical contour of said outer surface of said molded piece, and attaching said housing onto said molded piece in a radial alignment predetermined by said asymmetrical contours; and radially adjusting a radially adjustable securing element mounted on an outer surface of said housing on said molded piece.

22. A method for producing a plug connector for a data cable comprising an electrical line with a plurality of line leads and comprising an electrical shield, the method comprising:

deep-drawing an electrically conductive metal material into a deep-drawn tube forming a bush;

connecting said deep-drawn tube electrically conductively to said electrical shield;

compressing said deep-drawn tube for forming an annular bead;

stamping out or cutting out recesses and/or perforations and/or peripheral outer contours from said annular bead;

producing a molded piece, embodied as an injection molded part, with a central opening;

attaching said central opening of said molded piece onto said deep-drawn tube in such a way that said recesses, said perforations and/or said peripheral outer contours of said annular bead are press-fitted into complementary parts of said central opening of said molded piece.

23. The method as defined by claim 22, further comprising:

forming an inward-oriented tongue in said deep-drawing of said tube;

aligning said deep-drawn tube relative to said tongue, on placement of at least said annular bead of said deep-drawn tube in a tool for attaching on said central opening of said molded piece, in such a way that an unambiguous relative position is established between an outer contour of said molded piece and said tongue.

24. The method as defined by claim 23, further comprising:

forming an inward-oriented tongue in said deep-drawing of said tube;

providing said recesses, said perforations or said peripheral outer contours stamped or cut into said annular bead are provided with a mechanical code which establishes an unambiguous relationship between said tongue and said recesses, perforations or peripheral outer contours such that said central opening of said molded piece can be attached on only in a radial alignment with said annular bead.

25. The method as defined by claim 22, further comprising mounting an encircling crimp on said deep-drawn tube.

26. The method as defined by claim 23, further comprising:

producing a cylindrical insulating part with bores for receiving said plurality of line leads, or contact pins or contact sockets connected to plurality of line leads, and with a groove extending in a longitudinal direction of an outer surface of said cylindrical insulating part;

inserting said cylindrical insulating part into said bush in such a way that said tongue of said deep-drawn tube is inserted into said groove of said cylindrical insulating part.

27. The method as defined by claim 22, further comprising:

producing an asymmetrical contour on an outer surface of said molded piece;

producing a contour on an inner surface of said central opening of said housing that is adapted to said asymmetrical contour of said outer surface of said molded piece, and attaching said housing onto said molded piece in a radial alignment predetermined by said asymmetrical contours; and radially adjusting a radially adjustable securing element mounted on an outer surface of said housing on said molded piece.

* * * * *